United States Patent [19]

Kimball et al.

[11] Patent Number: 4,730,752

[45] Date of Patent: Mar. 15, 1988

[54] ANTI-SEATING VALVE CUP

[75] Inventors: James F. Kimball; Karl A. Kohler, both of Racine County, Wis.

[73] Assignee: S. C. Johnson & Son Inc., Racine, Wis.

[21] Appl. No.: 864,381

[22] Filed: May 19, 1986

[51] Int. Cl.[4] ..... B65D 83/00

[52] U.S. Cl. ..... 222/394; 141/3; 141/20

[58] Field of Search ..... 53/487–488, 53/79, 109; 222/386–387, 389, 402.1, 405, 394, 402.24; 29/509, 511; 220/67, 81 R; 141/3, 20

[56] References Cited

U.S. PATENT DOCUMENTS 3,245,591 4/1966 Kneusel et al. ..... 222/389
3,912,130 10/1975 Pelton ..... 222/396
4,211,344 7/1980 Stoody ..... 141/20 X
4,416,398 11/1983 Knickerbocker ..... 222/402.13

FOREIGN PATENT DOCUMENTS 1154268 6/1969 United Kingdom ..... 141/20

*Primary Examiner*—Joseph J. Rolla
*Assistant Examiner*—Michael S. Huppert

[57] ABSTRACT

A valve cup for use in an aerosol dispenser is configured to provide an anti-seating feature. In one embodiment, dimples are impressed in the sidewalls of a valve cup to inhibit seating of the valve cup flange on the circular shaped ring around the periphery of an opening at one end of the aerosol dispenser. In a second embodiment, detents are placed on the edge of the flange in which the sidewalls of the valve cup terminate to inhibit the seating of the flange on the circular shaped ring.

35 Claims, 11 Drawing Figures

ANTI-SEATING VALVE CUP

BACKGROUND OF THE INVENTION

1. Field of the Invention

The present invention pertains to aerosol containers and more particularly, to aerosol container valve cups configured with sidewalls terminating in a radially, outwardly extending flange adapted to seat on a circular shaped ring outlining a filling hole at one end of the container.

2. Description of the Prior Art

Aerosol containers, their dispensing mechanisms and methods of filling are well known in the art. Examples of various types of aerosol containers are found in U.S. Pat. Nos. 2,961,131 (Bradbury), 2,963,834 (Stanley, et al.), 3,477,195 (Chambers), 3,512,685 (Ewald), 3,995,666 (Michaels), 4,346,743 (Miller), and 4,441,634 (Meshberg).

Bradbury illustrates an aerosol bomb device having a cover which has its outer periphery formed as an annular flange 5 rolled over the edge 3 of the can (see FIGS. 2 and 4 of that patent). The base 7 of the cover has apertures 17. An apron 16 of flexible material such as nylon is placed below apertures 17 and is normally sealed shut against the apertures by the pressure of the contents. For injection of the pressure medium, the medium is supplied to orifices 17 under pressure and presses apron 16 away from the apertures (FIG. 4). If excessive pressure develops in the can during storage or use, the apron 16 bulges against projections 18 formed in the aperture 17. The projections 18 form small, temporary vent holes in the apron, permitting the escape of excess gas. After the venting is complete, the apron 16 resumes its ordinary shape, and the vent holes close up.

Stanley, et al., is directed to a system for filling and sealing receptacles, and shows the filling of a can 10 by first introducing the product into the can, placing the cup 15 thereon loosely, lifting the cup 15 off the can by means of vacuum suction (FIGS. 3 and 4 of that patent), introducing propellant in the liquid phase, and then replacing the cup 15 and crimping it in place on the can (FIG. 5).

Chambers illustrates a can containing a vertically collapsible, bellows-like accordion-pleated sack 40 which contains the product and separates it from a propellant. To charge the can with propellant without the need for providing a hole in the bottom of the can, the neck portion of the product sack is supported above the neck of the can and the propellant liquid is brought into the can through the space resulting between the can neck and the sack neck. In addition, grooves 52 are provided in an upper shoulder portion of the sack, which grooves serve as passages for the propellant liquid. A combined filling and crimping head supports the sack neck by means of a bracket 70 (see FIG. 4) and fills the can with a propellant, after which it forces the sack neck down into a close fit with the curled opening at the top of the can and crimps the down-turned peripheral flange 22 of the latter over the annular bead 23 provided at the periphery of the top opening of the can.

Ewald shows an aerosol container with an inner auxiliary plastic container 12. The open center tops of both the can 10 and the container 12 are closed by crimping a plastic-lined mounting cup 16 into the opening. A plastic disk 18 lines the inside of the cup and the space between the cup 16 and the plastic container 12, to provide a plastic-to-plastic seal, and to provide a closed, all-plastic container for the product and propellant with no exposure to the metal surface of the can 10 or mounting cup 16. This patent states that the can may be filled with product before the disk 18 and cup 16 are crimped into the can 10, or by pressure filling through the valve "in accord with customary practice." The plastic disk 18 (see FIGS. 2 and 3) may be extra thick at 30 to avoid the need for gasket material in that area.

Michaels pertains to a method for filling an aerosol spray dispenser containing liquid with a soluble gas propellant. According to the method to which this patent pertains, a mounting cup 12 is loosely placed on the top of can 10 containing a liquid 15. As shown in FIG. 2, a filling apparatus 16 is used to lift the cup 12 off the top of the can for filling. A vacuum is applied to cause air to flow from space 24 in the can upward around the bottom of mounting cup 12 to lift the cup into its raised or lifted position. Cup 12 is held against wall 22*a*, which prevents the cup from making the seal with a higher resilient member 23. Member 23 is then forced against the top of cup 12 to form a seal therewith, after which the cup 12 is again lifted off the top of the can 10 to permit injection of carbon dioxide or other suitable propellant (FIG. 4). After the propellant has saturated the liquid 15, the pressure drops and cup 12 is lowered onto the top of the can for crimping.

Miller relates to an aerosol container having an internal bag 28 to separate the product from the propellant. To provide the space between the neck of the product bag 28 and the can 18 to permit charging of the propellant into the space between the bag and the can, its neck extends above and through the top opening of the can to provide a space between them for propellant flow. The valve cup is placed on the top of the bag, and the two are shaped in such a way that a sealing flange of the valve cup engages an annular flange at the opening of the product bag, automatically clamping the two in sealing relation to each other. The product bag is made resilient so that upon initial application of the cup, the bag collapses vertically, forming a seal between the two elements. When the valve cup is released, the bag resiliently rises again to lift the valve cup and restore a clearance between the flange of the product bag and the flange of the can to permit propellant filling. After propellant filling, the valve cup is again depressed to clamp the container flange and the flange of the product bag together to seal against propellant escape.

Meshberg relates to filling a pressurized container comprising a mounting cup and a can containing both product and a pressurizing fluid, and shows a dispenser having a valve said to be adapted for fast pressure filling.

Aerosol containers and their associated valve cups are well known in the art, however, there is one recent problem associated with filling containers in a piston type dispenser.

This type of aerosol container normally has the usual one inch opening at the top which is adapted to receive a valve cup. The opening in the container has provisions for receiving the valve cup and ultimately, making a pressure type seal to insure against leakage of its contents, which is under pressure. A circular ring, or curl, surrounds the opening at the top of the container. The valve cup has sidewalls which fit into the opening at the top of the container. These sidewalls end in a radially, outward extending flange, which is shaped to seat on the curl encircling the opening of the container. The valve cup has a push type activated valve mounted at its center for dispensing the product within the aerosol container.

In a piston type aerosol dispenser, a beveled piston is placed at the bottom of the container and product is placed on top of the piston. The walls of the container act as a cylinder, against which the circumference of the piston fits. In filling the container, the valve cup is placed loosely in the hole at the top of the container. The flange on the valve cup rests on the curl or circular ring of the container top. Air is used to lift the valve cup and push product down around the piston to provide a product seal between the piston and the can walls. Under normal circumstances, valve cup lift is not obtained one hundred (100%) percent of the time. When valve cup lift is not obtained, the valve cup seats on the container curl, forming a seal which prevents proper operation of the filling apparatus. This results in non-functional units.

The problem of the valve cup flange prematurely seating on the container curl may occur in other aerosol filling processes when propellant is added. However, this problem does not create non-functional units to the extent that it does in piston type dispenser filling processes.

SUMMARY OF THE INVENTION

The present invention provides a solution to the problem of the valve cup flange seating on the circular ring around the opening in the aerosol container. Dimples are provided on the sidewalls of one embodiment. These dimples are of such size and configuration that they inhibit the valve cup from falling to its seated position during filling while permitting seating of the flange upon the circular ring at the opening of the aerosol container when a slight force is exerted on the valve cup. In a second embodiment, detents are provided on the flange to inhibit the valve cup from falling to its seated position. This detent may either be a single radiused detent, a single flat detent or multiple detents spread around the circumference of the flange.

DESCRIPTION OF THE PREFERRED EMBODIMENT

The present invention provides a method and apparatus for inhibiting the seating of a valve cup on an aerosol container during the filling process.

Figure 1:
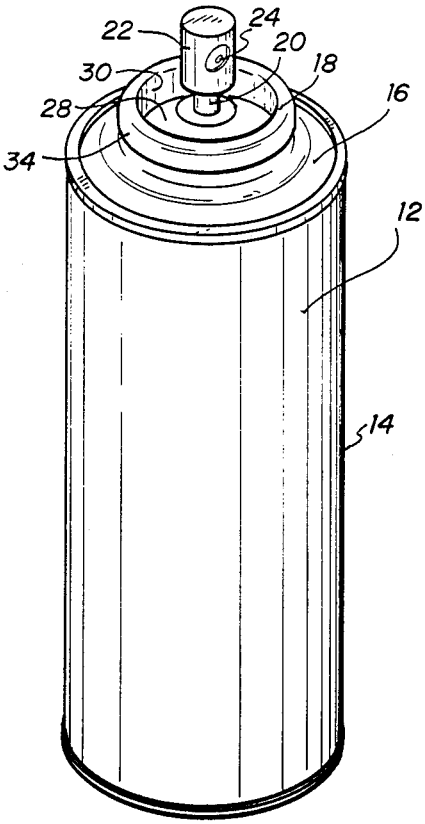
FIG. 1 is a perspective view of an aerosol container.

Referring now to FIG. 1, an aerosol container 12 is illustrated as comprising a cylindrical housing 14 having its upper end closed by a circular top 16 adapted to receive a valve cup 18 having a pressure activated valve 20 with an associated push actuator 22 having a nozzle opening 24. Top 16 normally has a one inch circular opening 26 (see FIG. 2) in which valve cup 18 fits.

Figure 2:
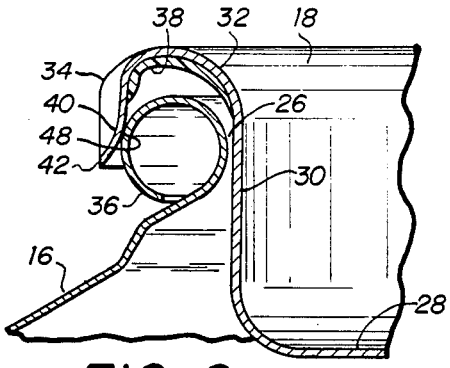
FIG. 2 is a sectional view of a portion of a valve cup and container top.
Figure 4:
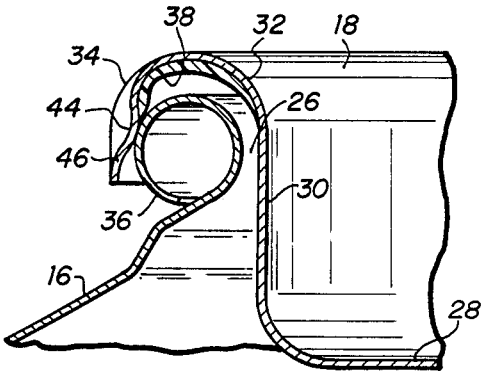
FIG. 4 is a sectional view of a portion of a second embodiment of the valve cup of the present invention and a container top.
Figure 3:
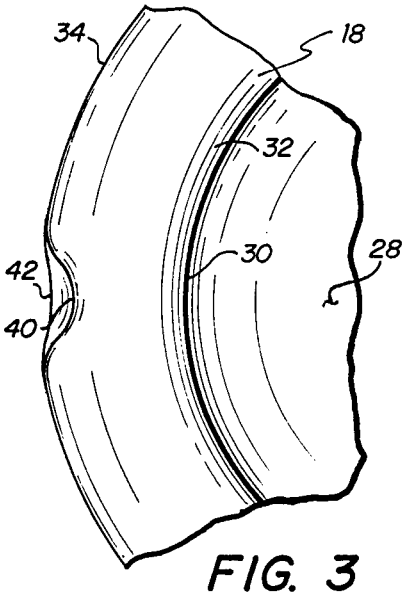
FIG. 3 is a plan view of a portion of the valve cup of FIG. 2.

Referring now to FIGS. 2 and 4, sectional views of a portion of valve cup 18 and top 16 are illustrated. FIG. 3 is top, plan view of the valve cup in FIG. 2.

Figure 10:
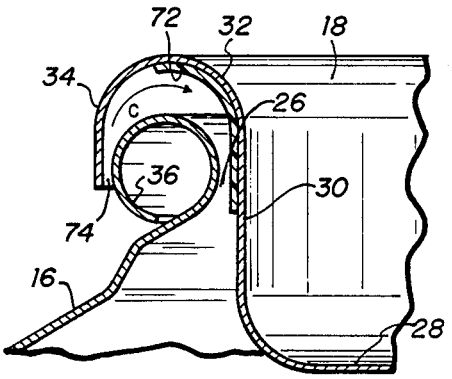
FIG. 10 is a sectional view of a portion of a container and a valve cup having a sleeve gasket at a point away from the detents.
Figure 11:
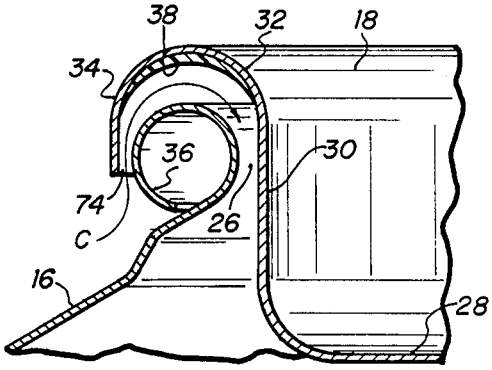
FIG. 11 is a sectional view of a portion of a container and a valve cup illustrating a gas flow area.

Valve cup 18 is illustrated as having a base 28 and a sidewall 30 forming a generally, cylindrical cup shape. Sidewall 30 ends in a radially, outwardly extending flange 32 which curls around forming an abbreviated outside sidewall 34. Top 16 forms hole 26 by curling up and around to form a circular curl section 36. Inside the flange 32 is a conventional resilient gasketing material which provides a seal after crimping. Typical gasketing materials include chloroprene, water-based latexes, polypropylene, etc. The gasketing materials can either be flowed into the cup or in the case of polypropylene and similar materials coat the entire valve cup. These gasketing materials ar conventional and do not form part of the present invention. A detent 40 is illustrated as resting on curl 36 holding flange 32 up and away from curl 36. Flange end 42 within detent 40 can be slightly less than the radius formed by outersidewall 34. Radiused detent 40 contacts curl 36 at a contact point 48 which is closer to the centerpoint of cup 18 than sidewall 34. As shown in FIGS. 10 and 11, those areas away from the detent have an opening between sidewall 34 and circular curl section 36.

FIG. 4 illustrates a further embodiment of valve cup 18 having an alternative detent configuration 44 with a curvature 46 returning to the line defined by an outer sidewall 34 of flange 32.

Figure 5:
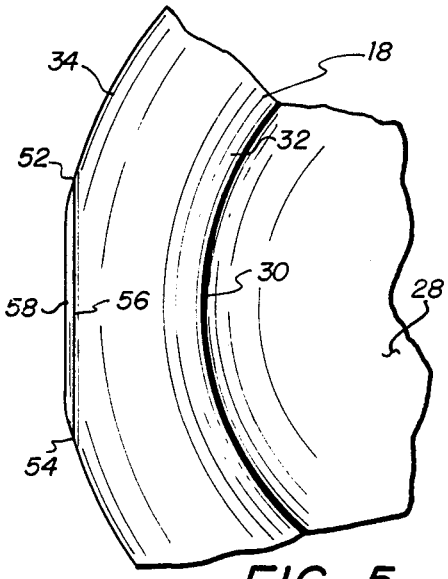
FIG. 5 is a plan view of a portion of an alternative embodiment of the valve cup of the present invention.

Referring now to FIGS. 3 and 5, plan views of valve cups are illustrated. As illustrated, detent 40 of FIG. 3 is a radiused detent curving inwardly to provide a shorter distance than the centerpoint of valve cup 18 to sidewall 34. In practice, radiused detents 40 can be spaced periodically around the outer sidewall 34 of flange 32 of valve cup 18. As few as one radiused detent 40 may be placed on flange 32 to provide sufficient lift to inhibit valve cup 18 from resting upon curl 36. FIG. 5 illustrates flat detent 58 as defining a straight line between points 52 and 54 on the outer sidewall 34 of flange 32. As with radiused detents 40, flat detent 58 has point 56 closer to the center of valve cup 18 than sidewall 34 to effectively prevent seating of flange 32 on curl 36. As with radiused detents 40, one or more flat detents 58 may be spaced along the circumference or outer sidewall 34 of flange 32. Multiple detents can be used to stabilize the cup or to provide centering within can opening 26, if concentricity is required. Preferably the detents are uniformly spaced apart. One preferred embodiment uses two detents spaced 180° apart, while a second embodiment uses three detents spaced 120° apart.

Figure 6:
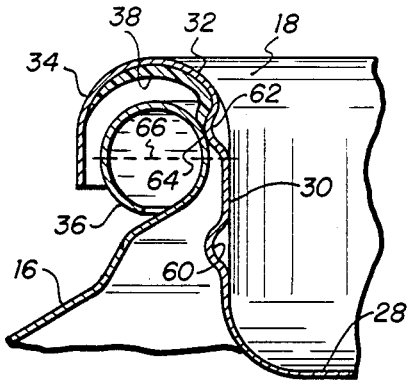
FIG. 6 is a sectional view of a portion of a container and a valve cup having a detent on its inner wall.

Referring now to FIG. 6, valve cup 18 is illustrated with top 16 as having dimples 60 and 62 located on sidewall 30. Dimple 60 is used to prevent easy withdrawal of valve cup 18 once it has been inserted in opening 26 of top 16. An additional dimple 62 is provided to increase the distance of sidewall 30 from the centerpoint of valve cup 18. By doing this, valve cup 18 will rest on dimple 62 situated on curl 36. It should be noted that in FIG. 6, dimple 62 is situated such that when flange 32 rests on curl 36, a point 64 will not pass horizontal centerline 66 of circular curl 36. If valve cup 18 were forced down, dimple 62 through its most outwardly extending point 64, will force sidewall 30 inward. Since a compressed position for sidewall 30 is not a normal at rest position, dimple 62 through point 64 will ride upward along the outer circumference of curl 36 as sidewall 30 moves to its rest position. Preferably, multiple dimples 62 can be used to stabilize the cup or provide centering within opening 26. Most preferably, the dimples are uniformly spaced apart. One preferred embodiment uses 2 dimples spaced 180° apart, while another uses 3 dimples spaced 120° apart.

Figure 7:
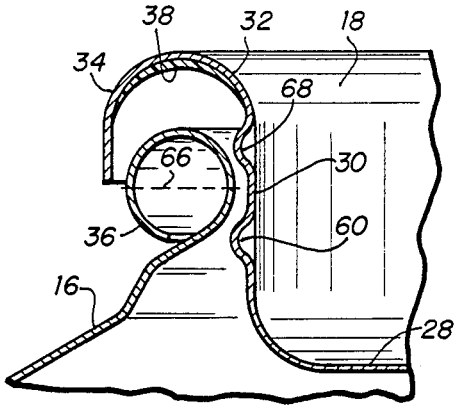
FIG. 7 is a sectional view of a portion of a container and a valve cup having two sets of dimples.

Referring now to FIG. 7, a dimple 68 is illustrated as being positioned lower along sidewall 30 than dimple 62 of FIG. 6. By positioning dimple 68 well below the curvature of flange 32, final seating of flange 32 on curl 36 is considerably easier, however, care must be taken so that valve cup 18 is not placed in opening 26 prior to gas filling to such an extent that dimple 68 is below centerline 66 of the circle defined by curl 36. When this is done, valve cup 18 will be positioned such that flange 32 is seated on curl 36 and sealing material 38 will provide a seal.

Figure 8:
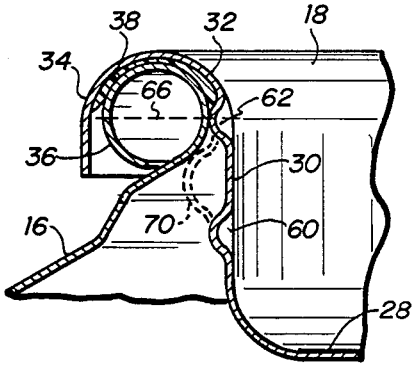
FIG. 8 is a sectional view of a portion of a container and a valve cup illustrating a normal crimp position.

Referring now to FIG. 8, the dimpled arrangement of FIG. 6 is illustrated as being forced into its final seated position. When dimples such as dimples 62 of FIG. 6 are used, valve cup 18 must be forced and held into position in order for the seal to be made between flange 32 and curl 36 by sealing material 38. Valve cup 18 is held in position and sidewall 30 is crimped or forced out to a position as indicated by dashed area 70.

Dashed area 70 extends all around sidewall 30 of valve cup 18. Since the radius defined by the distance from area 70 to the center of cup 18 is greater than the radius of opening 26 in top 16, valve cup 18 is held in place.

In some standard undercup filling operations, filling accuracies may be improved as the cup is held off the can curl. The anti-seating detent will help prevent propellent from prematurely forcing the cup against the curl, sealing the can prior to complete filling.

Figure 9:
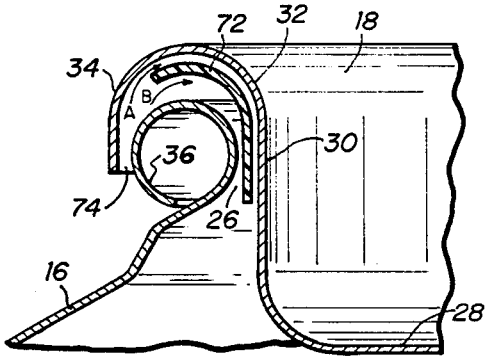
FIG. 9 (PRIOR ART)
FIG. 9 is a sectional view of a portion of a prior art container and a valve cup having a sleeve gasket.

Further, with a polymeric sleeve gasket valve 72, the blow-in of the gasket into the can is a main cause of aerosol unit failures. In these valve cups, a plastic sleeve, which serves as a gasketing material, is fitted to the valve cup, yet is not attached through adhesive or mechanical means. In a prior art filling operation as shown in FIG. 9, where propellent flow is intended to lift the cup, one of two paths for propellent flow into the can may be followed. Propellent can flow through either path "A", above the gasket 72, or path "B", below the gasket 72. A tendency for increased turbulence in this area is invisioned, and the turbulence, in conjunction with a non-directed flowpath, can force the gasket 72 into the can, thus causing a failure.

In these prior art filling processes where either propellant or air is forced under valve cup 18 through outer opening 74 into opening 26 to lift the valve cup, the gas may take either a path designated by arrow A or a path designated by arrow B. If a path designated by arrow A is taken, gasket 72 may be displaced such that it will not be in position for seating between flange 32 and curl 36. By use of the detents or dimples of the present invention, valve cup 18 is held up away from curl 36 and any gas being forced through opening 26 should follow the path defined by arrow B.

FIG. 10 shows a polymeric sleeve gasket 72 used with the anti-seating detent of the present invention. In this position a clear flow path C is provided and the likelihood of turbulence and/or gasket blow-in is greatly reduced.

Referring now to FIGS. 2 and 11, air paths are illustrated for the embodiment using detent 40 to hold valve cup 18 above top 16. FIG. 2 is a cross-sectional view of the area where detent 40 rests against curl 36 of top 16. FIG. 11 illustrates areas where outer edge 34 is positioned away from curl 36 of top 16. Since both radiused detents 40 and flat detents 44 are spaced apart along the outer sidewall 34 of flange 32, the vast majority of the flange area is not in contact with curl 36 and propellant or air may be forced into aerosol container 12 quite readily as shown by arrow C.

In operation, valve cup 18 is placed within opening 26 and resting on curl 36 of top 16 after product has been placed into aerosol container 12. In most processes, a vacuum step takes place which draws valve cup 18 away from curl 36 and creates a space between flange 32 and curl 36 allowing free flow of gas through opening 26 defined by the edge of curl 36 and sidewall 30. Should anything happen to the vacuum drawn on valve cup 18, it will fall so that flange 32 with sealing material 38 rests on curl 36, preventing influx of propellant or other gas that is being placed inside container 12. In the piston type aerosol dispenser, where propellant is inserted through the bottom of the can and a piston rides along cylinder walls 14 to dispense a product through valve 20, air is forced through opening 26 after the product has been placed in container 12. The air is forced to create a pressure which causes a product seal between the piston and cylinder walls 14. This type of process does not have a vacuum step and lift of valve cup 18 is provided by the injection of air under pressure. This process does not guarantee that valve cup 18 with flange 32 will be lifted from curl 36, allowing air to enter through opening 26. Thus, the detents of one embodiment and the dimples of a second embodiment of the present invention, assure lifting of valve cup 18 with flange 32 above curl 36 and allow air to enter through opening 26.

While the present invention has been described by way of preferred embodiment, it is to be understood that this description is for illustration purposes only and the invention should not be limited thereto, but only by the scope of the following claims:

What is claimed is:

1. A valve cup for use on an aerosol container comprising:

a cylindrical shaped cup having a sidewall ending in a radially, outwardly extending flange adapted to seat on the periphery of an opening of the aerosol container to seal said opening, said sidewall having at least one surface irregularity extending partially along the circumference of said sidewall that provides resistance to seating on said periphery and to sealing said opening.

2. The valve cup according to claim 1, wherein said surface irregularity includes a first set of dimples located on said sidewall.

end partially closed by a disc having a circular center hole with a circular shaped ring around its periphery, said center hole adapted for receiving a valve cup comprising a cup shaped member having its center adapted for mounting a push type valve, said cup shaped member having a sidewall terminating in a radially, outwardly shaped flange, said flange configured for seating upon said circular shaped ring, the circumference of said flange having at least one flat detent for inhibiting seating of said flange upon said circular shaped ring.

34. The combination of claim 33 wherein said flange has at least 2 flat detents spaced apart along said flange.

35. The combination of claim 34 wherein said detents are spaced evenly along said flange.

* * * * *